United States Patent [19]

Boucher

[11] 4,348,051

[45] Sep. 7, 1982

[54] SEAT WITH ADJUSTABLE FOOT-REST

[75] Inventor: Guy Boucher, Paris, France

[73] Assignee: La Telemecanique Electrique, France

[21] Appl. No.: 206,406

[22] Filed: Nov. 12, 1980

Related U.S. Application Data

[63] Continuation of Ser. No. 20,132, Mar. 13, 1979, abandoned.

[30] Foreign Application Priority Data

Mar. 14, 1978 [FR] France ..... 78 07319

[51] Int. Cl.[3] ..... A47C 7/50

[52] U.S. Cl. ..... 297/423; 297/437; 248/405

[58] Field of Search ..... 297/423, 429, 437; 248/404, 405, 406; 108/105, 141, 95

[56] References Cited

U.S. PATENT DOCUMENTS

| | | | |
|---|---|---|---|
| 135,557 | 2/1873 | Huffman | 297/423 |
| 275,413 | 4/1883 | Rich | 248/405 |
| 471,184 | 3/1892 | Milner | 248/405 |
| 636,632 | 11/1899 | Carlton | 108/95 |
| 912,505 | 2/1909 | Stockwell | 248/406 X |
| 1,160,108 | 11/1915 | Hasty | 248/406 |
| 1,721,221 | 7/1929 | Jaurequi | 297/429 |
| 1,723,363 | 8/1929 | McArdle | 248/405 X |
| 2,308,358 | 1/1943 | Cramer | 297/437 |
| 2,659,413 | 11/1953 | Cramer | 297/437 |

*Primary Examiner*—Francis K. Zugel

*Attorney, Agent, or Firm*—William A. Drucker

[57] ABSTRACT

A seat has a foot-rest which is adjustable in height in simple manner by reason of the fact that it is pivoted on one of the threaded portions already present either on a column fast to a base or on a support fast to a seat proper.

4 Claims, 4 Drawing Figures

40
5'''
4'''
6
2'''
1
15
18
7
9
3'''

13
V
40
6
4
5
10
11
1
14
3
7
8
9
V'
12
16
2
17

SEAT WITH ADJUSTABLE FOOT-REST

This is a continuation of Ser. No. 20,132, filed Mar. 13, 1979, now abandoned.

BACKGROUND OF THE INVENTION

The invention relates to a seat, adjustable in height, in which the seat member and the backrest are fast with a vertical cylindrical support comprising a first threaded portion engaged in a second threaded portion carried by a vertical column fixed on a base resting on the ground, a foot-rest concentric with the common axis of the support and the column being associated in height-adjustable manner with said support or said column. In the known manner, the foot-rest is carried either by the support for the seat member, or by the column, and in all cases on the external surface thereof. As a result, this surface being exposed to external atmospheric agents, it eventually deteriorates, above all in an industrial environment, and the operation of the height adjusting means of the foot-rest cannot be readily performed.

Furthermore, the height adjusting means generally used in this case do not permit a fine adjustment of the height; further, the manipulation of this device requires the user of the seat to descend from it, then to get on it again in order to ascertain if the adjustment is suitable, as a consequence of which there is a loss of time or non-use of the adjustment means.

OBJECT OF THE INVENTION

The invention proposes to remedy the inconveniences indicated above, and thus to provide a seat with which the adjustment of height of the foot-rest is easy and progressive, and with which the surfaces of the movable elements displaced during the said adjustment are sheltered from external agents.

SUMMARY OF THE INVENTION

According to the invention this result is obtained by reason of the fact that the foot-rest comprises a third threaded portion cooperating with an extension of the threaded portion carried by either one of the first and second threaded portions.

BRIEF DESCRIPTION OF THE DRAWINGS

The invention will be better understood from the following description with reference to the accompanying drawings, wherein.

DESCRIPTION OF THE PREFERRED EMBODIMENT

Figure 1:
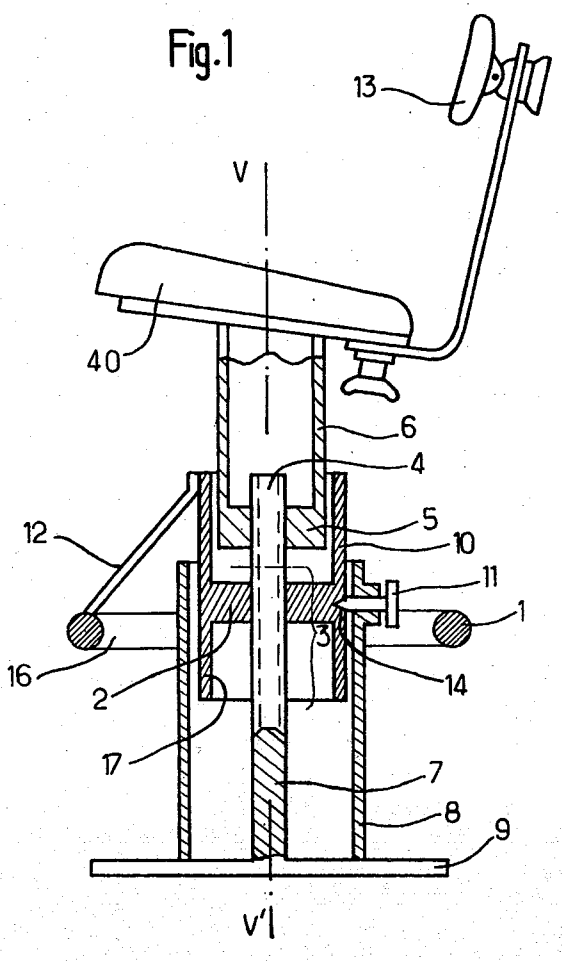
FIG. 1 shows a first manner of construction of the invention.

The seat shown in FIG. 1 comprises principally a base 9 resting on the ground and carrying at its end remote from the ground a vertical column 7, with axis VV', provided with an external threaded portion 4 at its upper extremity, and a hollow cylindrical support 6 having at its lower extremity 5 an internally threaded portion 4; this support is concentric with the axis VV' and carries at its upper extremity a seat member 40 and a back rest 13.

A foot-rest 1 constituted for example by a metal ring 16 with an axis concentric with the axis VV' is joined to a cylindrical socket 10 by a number of arms such as 12; this socket, which is placed concentrically with the axis VV', comprises internally a threaded region 2 which is engaged on an extension of the threaded portion 3 placed between the portion 4 and the base 9. The cylindrical socket 10 is advantageously extended by a skirt 17 comprising for example notches or a longitudinal groove 14 intended to receive the end of a locking member 11, for example a screw or a resilient locking bolt, the putting into place of which can be carried out by the operator from his seat or from the ground. In the example cited, this locking member is disposed on a cylindrical housing 8 concentric with the axis V' and fast with the base. According to whether this housing is internally of or externally of the skirt 17, it is possible to choose to dispose the locking member on the skirt or on the housing.

It will be clearly seen that the user of the seat, once seated, will be able to cause with his feet, without being obliged to descend from it, a rotation of the footrest which will result in an adjustment of its height.

Figure 2:
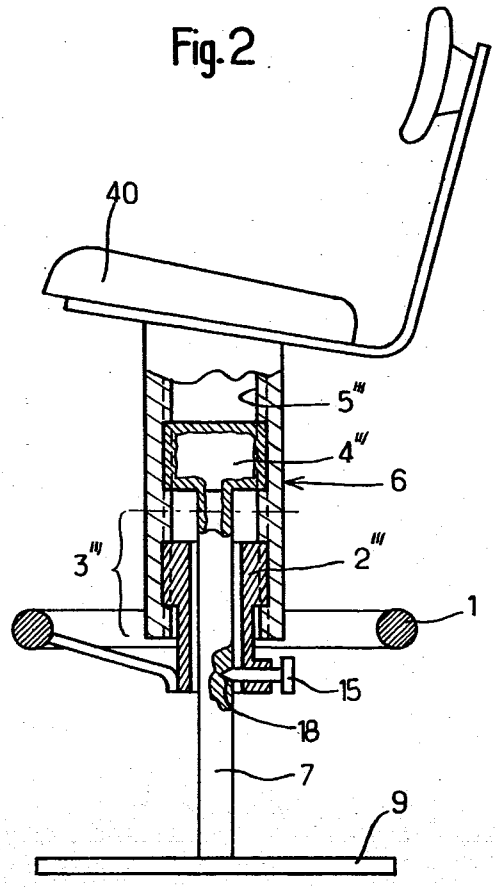
FIGS. 2 to 4 illustrate other manners of construction.

In the manner of construction of FIG. 2, an extension of the threaded portion 3''' of the threaded portion 5''' has been disposed on the internal cylindrical surface of the tubular support 6 whilst the threaded portion 2''' fast to the foot-rest is engaged with 3'''. This threaded extension 3''' of the threaded portion 5''' receiving the threaded extremity 2''' of the foot-rest is disposed as in the example of FIG. 1 between the portion 4''' and the base 9.

The locking means are constituted here by the member 15 of the foot-rest cooperating with the notch or groove 18.

Figure 4:
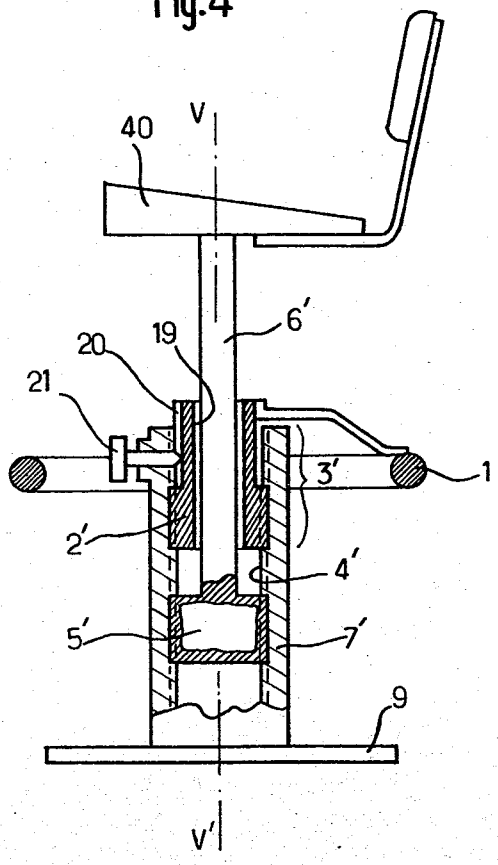
Figure 3:
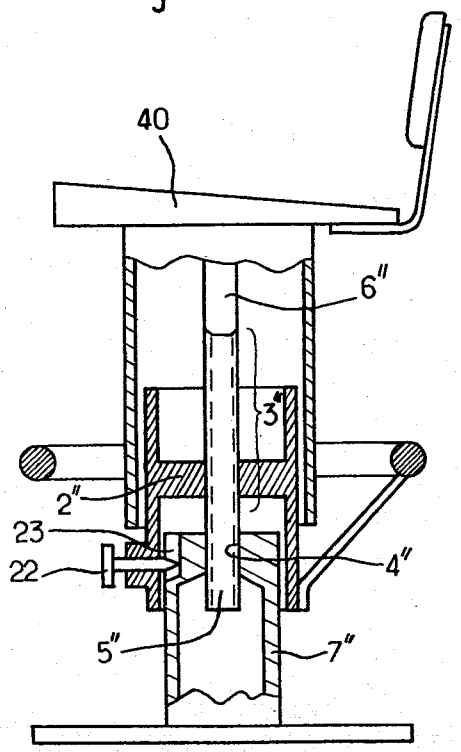

In the examples of construction of FIGS. 3 and 4, the column is formed by a tube 7' or 7'' fast with the base. This tube carries the internal threaded portion 4' or 4'' which receives the threading 5' or 5'' carried by the support 6' or 6'' presented here in the form of a threaded cylindrical rod. The foot-rest 1 is fast either with a screw 2' having an opening 19 giving passage to the support 6' and engaged on the threaded extension 3', or with a nut 2'' engaged on the portion 3'' of the support 6'' which forms the extension of the portion 5''.

In these two cases, the threaded portion 2',2'' fast with the foot-rest, as well as the extensions 3',3'' which receive them, are situated between the seat member and the threaded surface 5',5'' placed at the extremity of the support.

In a manner analogous to that of the preceding examples, the locking in position of the foot-rest is obtained by means of a member 20 or 22 fast with the said foot-rest cooperating in a movable manner with a complementary member 21 or 23 made angularly fast with the column and thus with the base.

I claim:

1. In a seat, adjustable in height and having a seat-member, a backrest and a foot-rest having a cylindrical hub and a ring shaped outer part concentrically mounted about said hub, the improvement which comprises: a first cylindrical column having a free upper end and a base resting on the ground and connected to the lower end of the first column, the said first column having a first threaded portion and a second threaded portion, the said hub having a third cylindrical threaded portion which cooperates with the first threaded portion of the first column; and a second column supporting the seat member and the back-rest, said second column having a fourth threaded portion cooperating with the second threaded portion of the first column, the first and second columns and the third threaded portion having a common axis.

2. In a seat, according to claim 1, the improvement wherein the second column and the third threaded portion are tubular and concentrically arranged about the first column, the first threaded portion being adjacent to the free upper end of the first column and the first and second threaded portions being located on the outer surface of the first column.

3. In a seat, according to claim 1, a cylindrical housing mounted integral with said base, concentrically with said columns and extending around said hub; and adjustable locking means mounted on said housing and adapted to cooperate with said hub.

4. In a seat, according to claim 2, a cylindrical housing mounted integral with said base, concentrically with said columns and extending around said hub; and adjustable locking means mounted on said housing and adapted to cooperate with said hub.

* * * * *